US005650751A

United States Patent [19]

Symons

[11] Patent Number: 5,650,751

[45] Date of Patent: Jul. 22, 1997

[54] INDUCTIVE OUTPUT TUBE WITH MULTISTAGE DEPRESSED COLLECTOR ELECTRODES PROVIDING A NEAR-CONSTANT EFFICIENCY

[75] Inventor: Robert Spencer Symons, Los Altos, Calif.

[73] Assignee: Litton Systems, Inc., Woodland Hills, Calif.

[21] Appl. No.: 453,569

[22] Filed: May 26, 1995

Related U.S. Application Data

[63] Continuation of Ser. No. 116,457, Sep. 3, 1993, abandoned.

[51] Int. Cl.[6] ..... H01J 25/02

[52] U.S. Cl. ..... 330/45; 315/5.37; 315/5.38; 313/293; 313/447

[58] Field of Search ..... 315/5.37, 5.51, 315/5.38; 330/44, 45; 328/64; 313/293, 447

[56] References Cited

U.S. PATENT DOCUMENTS

| | | | |
|---|---|---|---|
| 2,325,865 | 8/1943 | Litton | 315/5.38 |
| 4,096,409 | 6/1978 | Hechtel | 315/5.38 |
| 4,395,656 | 7/1983 | Kosmahl | 315/4 |
| 4,480,210 | 10/1984 | Preist et al. | 315/4 |
| 4,611,149 | 9/1986 | Nelson | 313/293 X |
| 4,733,192 | 3/1988 | Heppinstall et al. | 330/45 |
| 4,737,680 | 4/1988 | True et al. | 315/5.37 X |
| 4,794,303 | 12/1988 | Hechtel et al. | 315/5.38 |
| 5,281,923 | 1/1994 | Heppinstall | 315/5.37 X |
| 5,283,534 | 2/1994 | Bohlen et al. | 330/45 |
| 5,317,233 | 5/1994 | Lien et al. | 315/5.37 |
| 5,420,478 | 5/1995 | Scheitrum | 315/5.38 |
| 5,440,202 | 8/1995 | Mathews et al. | 315/5.38 X |

FOREIGN PATENT DOCUMENTS

| | | |
|---|---|---|
| 0181214 A1 | 5/1986 | European Pat. Off. . |
| 547715 | 9/1942 | United Kingdom . |
| 1549923 | 8/1979 | United Kingdom . |
| 2143370 | 6/1984 | United Kingdom . |

OTHER PUBLICATIONS

Modern Multistage Depressed Collectors–A Review, by Henry G. Kosmahl, Proceedings Of The IEEE, vol. 70, No. 11, Nov. 1982, pp.: 1325–1334.

The Klystrode–An Unusual Transmitting Tube With Potential for UHF–TV, by Donald H. Preist and Merrald b. Shrader, Proceedings Of The IEEE, vol. 70, No. 11, Nov. 1982, pp. 1318–1325.

Microwave Tubes, by A.S. Gilmour, Jr., Artech House, Inc., 1986, Chapter 8 Gridded Tubes, Section 8.2 Klystrodes, pp. 196–200.

*Primary Examiner*—Benny T. Lee
*Attorney, Agent, or Firm*—Graham & James LLP

[57] ABSTRACT

A high efficiency linear amplifier comprises an electron gun assembly having a cathode and an anode, the cathode being operable at a relatively high voltage potential relative to the anode to form and accelerate an electron beam. A control grid is disposed between the cathode and the anode, and is biased relative to the cathode for Class B operation. A high frequency input signal is applied to the control grid to density modulate the electron beam. A shadow grid may be disposed between the control grid and the cathode. A drift tube encloses the beam and includes a first portion and a second portion with a gap defined between the first and second portions. An inductive output cavity communicates with the gap, and the density modulated electron beam passed across the gap and induces an RF electromagnetic signal into the cavity. A multistage depressed collector accepts and dissipates the electrons of the beam which remain after transit across the gap. Each of the collector stages have electric potential applied thereto ranging between ground and the cathode potential to efficiently collect the electrons. The electric potential can be specifically selected to preclude the collection of electrons at the beam potential, and maximize the efficiency of the amplifier.

22 Claims, 3 Drawing Sheets

INDUCTIVE OUTPUT TUBE WITH MULTISTAGE DEPRESSED COLLECTOR ELECTRODES PROVIDING A NEAR-CONSTANT EFFICIENCY

This is a continuation of application Ser. No. 08/116,457 filed on Sep. 3, 1993 now abandoned.

BACKGROUND OF THE INVENTION

1. Field of the Invention

The present invention relates to efficient amplification of radio frequency (RF) power, and more particularly, to a linear amplifier for ultra high frequency (UHF) applications which combines an inductive output tube with a multistage depressed collector to achieve substantially constant efficiency.

2. Description of Related Art

The advent of high definition television (HDTV) has provoked renewed interest in the efficient amplification of UHF signals. HDTV transmitting systems will require amplifiers capable of extremely high data rates on the order of twenty-five megabits per second. To support these high data rates, digital modulation techniques, such as four or six level vestigial sideband modulation or 16 or 32 state double sideband quadrature amplitude modulation (QAM) are proposed. These forms of modulation, when used in a channel of limited bandwidth (for example 6 MHz), result in signals which have high ratios of peak to average power. It is extremely difficult to amplify such signals both efficiently and faithfully, that is, with very low distortion of the modulation content as measured by the absence of high-order intermodulation products. Thus, RF linear amplifiers capable of providing these characteristics are very desirable.

Traditionally, klystrons were used as the high power amplifiers for most UHF transmitters. A klystron is a linear beam device having an electron beam which is passed through a plurality of cavities. An RF input signal velocity modulates the beam and causes it to become bunched. The bunched beam induces an RF current in the cavities, and energy can be extracted from the bunched beam as an amplified RF output signal. However, klystrons are very inefficient at output powers lower than the maximum for which they are designed since they operate at constant voltage and current, and their efficiency is proportional to the output power.

A known technique for increasing the efficiency of a klystron is the use of a multistage depressed collector (MSDC). The electrons of the velocity modulated beam have widely varying energy levels as they exit from the output cavity. By using a multiplicity of collector electrodes which are depressed to potentials below that of the device body (i.e. the potential corresponding to the original electron beam energy), the spent electrons of the beam can be collected at the minimum possible energy. The electrons may be considered analogous to balls having various velocities that might roll up a hill until they stop and then roll back into traps on either side of their upward path. By recovering most of the remaining kinetic energy of the spent electron beam in depressed stages, beam energy is not lost by conversion of the kinetic energy into heat, and higher operating efficiency can be achieved. Multistage depressed collectors are described in Kosmahl, *Modern Multistage Depressed Collectors—A Review*, Proceedings of the IEEE Volume 70, page 1325 (1982).

The efficiency of MSDC klystrons averaged over the modulation cycle has been shown to be up to three times that of conventional klystrons. Since the voltage at which the electrons are collected is roughly proportional to the RF output voltage of the klystron and the beam current is constant, the efficiency of the MSDC klystron is proportional to the square root of the output power. Despite this improved efficiency, MSDC klystrons do not provide the linearity necessary for the proposed HDTV transmitting systems.

Another type of amplifier utilizes one or more grids disposed between a cathode and an anode to density modulate current drawn from the cathode. It is a common practice to differentiate between amplifiers which use a grid to density modulate the electron stream on the basis of their operating regime, and they are categorized as either Class A, B or C. In a Class A amplifier, the grid bias and alternating grid voltages are applied such that the cathode current flows continuously through the electrical cycle. In a Class B amplifier, the control grid is operated at close to cutoff such that cathode current flows only during approximately half of the electrical cycle. Class AB amplifiers are hybrids of Class A and Class B amplifiers in which grid bias and alternating grid voltages are such that the beam current flow appreciatively more than half but less than the entire electrical cycle. Class C amplifiers have the grid bias appreciably greater than cutoff so that cathode current flows for appreciably less than half of the electrical cycle.

At lower frequencies, Class B amplifiers using triodes or tetrodes have demonstrated an ability to produce power more efficiently than conventional klystrons. In these amplifiers, the RF output current varies linearly with the cathode current and the voltage is constant, so the efficiency again varies as the square root of the output power as it does in the MSDC klystron. Tetrode and triode Class B amplifiers are effective for very high frequency (VHF) operation.

The advantages of Class B operation can be extended to higher frequencies by using a device known as an inductive output tube. Inductive output tubes have the same efficiency as other Class B amplifiers due to the fact that the RF input signal applied to a control grid causes the electron beam current to vary roughly as the RF drive voltage. Since the RF current in the tube does not result from velocity modulation, the amplifier is additionally highly linear.

The original inductive output tube was developed by A. V. Haeff, and consisted of a tubular glass envelope containing a cathode, a control grid disposed in front of the cathode, an accelerating aperture electrode and a collecting electrode. A gap of a reentrant cavity was disposed in part of the tubular glass envelope between the accelerating aperture electrode and the collecting electrode. The electron beam generated by the cathode passed through the gap when focused by a magnetic field. When the electron beam was density modulated by the application of an RF input signal to the control grid at a frequency equal to the resonant frequency of the cavity, the electron beam current induced an electromagnetic wave in the cavity which extracted energy from the electrons without intercepting the electrons. The inductive output tube had the advantage over earlier vacuum tubes in that the interaction gap of the cavity could be of small area and have a low capacitance suitable for high frequency operation, while the electrons could be collected on a much larger collector electrode which no longer needed to be part of the resonant circuit.

The original concept for the inductive output tube was later recognized as being advantageous for use as a linear amplifier for UHF television signals. A modernized inductive output tube is disclosed in U.S. Pat. No. 4,480,210 for GRIDDED ELECTRON POWER TUBE, which includes a highly convergent electron gun with a pyrolytic-graphite control grid and a large collector. Making the control grid of pyrolytic-graphite, a highly refractory material, permits a much higher current density than previously possible in the original Haeff inductive output tube. This updated tube became known as a "klystrode" since it combined features of conventional klystrons with those of tetrodes; the klystrode has the resonant output cavity of a klystron, and the four electrode configuration of the tetrode.

Despite widespread knowledge of MSDC klystron and IOT efficiency enhancing techniques, a combination of the benefits of the inductive output tube with the multistage depressed collector was not actively pursued. The common wisdom in the art was that any improvement in efficiency gained by combining these features would be only on the order of 10% to 15% at peak power levels, and thus would not be worth the additional investment to modify existing designs. See Gilmour, *Microwave Tubes*, pages 196–200 (Artech House 1986). Moreover, it was believed that collector depression would require an increase in the cathode to anode voltage for a given power output, and if too much depression was used in attempting to increase efficiency, a deterioration in picture quality due to returned electrons across the cavity gap would result. See Preist & Shrader, *The Klystrode—An Unusual Transmitting Tube With Potential For UHF-TV*, Proceedings of the IEEE, volume 70, pages 1318 (1982).

Thus, it would be desirable to provide an RF amplifier for UHF applications that provides higher operating efficiency levels and linearity than that previously achieved in the art. Ideally, the RF amplifier would provide constant high efficiency at any power level rather than the square root of output power relationship provided by inductive output tubes and multistage depressed collector klystrons.

SUMMARY OF THE INVENTION

In accordance with the teachings of this invention, an improved RF amplifier is provided for amplifying a radio frequency signal having a high ratio of peak to average power. The RF amplifier combines the teachings of the inductive output tube with the multistage depressed collector klystron to obtain enhanced operating efficiency and linearity. The teachings of the prior art failed to recognize that the combination of these technologies would result in a huge increase in efficiency at low power levels substantially below the maximum level which the amplifier is capable. Near constant efficiency is achieved across the operating range, which greatly exceeds the square root of power efficiency levels expected from conventional inductive output tubes. Also, enhanced linearity may be achieved by avoiding severe electron slowing in the output gap without any efficiency penalty.

More specifically, the amplifier comprises an electron gun assembly having a cathode and an anode, the cathode being operable at a high voltage potential relative to the anode to form and accelerate an electron beam. A control grid is disposed between the cathode and the anode, and accepts a high frequency input signal to density modulate the electron beam. The control grid is biased relative to the cathode to preclude transmission of the electron beam during the negative half cycle of the high frequency signal. A shadow grid may be disposed between the control grid and the cathode. A drift tube encloses the beam and includes a first portion and a second portion with a gap defined between the first and second portions. An inductive output cavity communicates with the gap, and the density modulated electron beam passes across the gap and induces an RF electromagnetic signal into the cavity. A multistage depressed collector accepts and dissipates the electrons of the beam which remain after transit across the gap. Each of the collector electrodes have electric potential applied thereto ranging between ground and the cathode potential to efficiently collect the electrons.

Linearity of the amplifier is improved by reducing the RF voltage in the output cavity relative to the beam voltage. Efficiency is maximized by adjusting the potential of the first collector electrode so that no current is collected at beam potential. For example, if the maximum peak RF voltage were reduced to 90% of the beam voltage, all the beam current could be collected on a collector electrode having a DC potential equal to 90% of the anode to cathode potential, but the slowest electrons would still retain one-tenth of their energy or 0.316 times their initial velocity after crossing the output gap. Thus, the current induced in the output gap will be more nearly proportional to the RF beam current and phase distortion will be reduced. Also, when one or more collector electrodes are operated at less than full beam potential, the efficiency characteristics can be matched to the signal modulation statistics to optimize average efficiency by adjusting the individual collector electrode potentials.

A method for amplifying a UHF frequency signal includes the steps of: accelerating an electron beam from an electron gun assembly having a cathode and an anode (at ground potential) spaced therefrom by application of a relatively high potential between the cathode and the anode; density modulating the electron beam by application of the UHF frequency signal to a control grid disposed between the cathode and the anode; biasing the control grid relative to the cathode to preclude transmission of the electron beam during the negative half cycle of the UHF frequency signal; inducing an RF electromagnetic signal into a cavity by passing the density modulated beam across a gap communicating with the cavity; extracting the RF electromagnetic signal from the cavity; and collecting the electrons of the beam remaining after transit across the gap on a plurality of electrode stages each having electric potential applied thereto ranging between ground and the cathode potential.

A more complete understanding of the inductive output tube with multistage depressed collector electrodes will be afforded to those skilled in the art, as well as a realization of additional advantages and objects thereof, by consideration of the following detailed description of the preferred embodiment. Reference will be made to the appended sheets of drawings which will be first described briefly.

DETAILED DESCRIPTION OF THE PREFERRED EMBODIMENT

The present invention provides an RF amplifier that offers higher operating efficiency levels and linearity than that previously achieved in the art. This improvement is accomplished by combining the high efficiency characteristics of inductive output tubes and multistage depressed collectors, and operating the combined device as a Class B amplifier.

Figure 1:
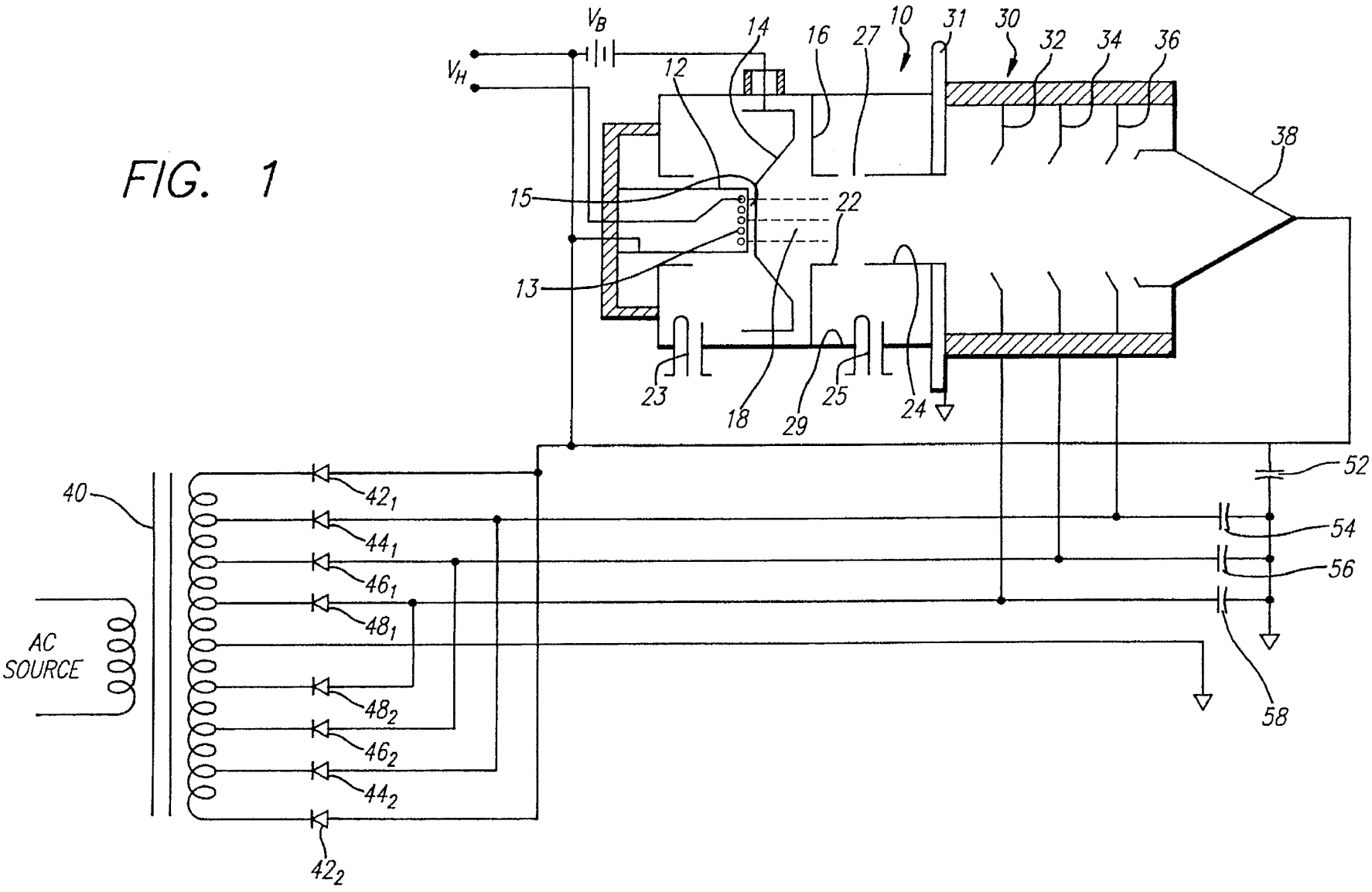
FIG. 1 is a schematic drawing of an inductive output tube having a multistage depressed collector of the present invention.

Referring now to FIG. 1, a schematic drawing of a high efficiency inductive output tube (IOT) 10 having a multistage depressed collector (MSDC) 30 is illustrated. The IOT 10 includes a generally cylindrical electron gun 12 having a thermionic cathode 15 with a heating coil 13 disposed below the cathode surface coupled to a heater voltage source $V_H$. A control grid 14 is positioned closely adjacent to the surface of the cathode 15, and is coupled to a grid bias voltage source $V_B$. An axially apertured anode 16 is disposed downstream from the cathode 15 and control grid 14 at the beginning of a drift tube section which comprises a first portion 22 and a second portion 24. The drift tube portions are separated by a gap 27, which opens to a cavity 29. An RF input 23 comprising an inductive loop is disposed adjacent to the control grid 14 such that an RF input signal is coupled to the grid. Alternatively, input coupling to the control grid 14 may also be capacitative. An RF output 25 comprising a inductive loop is disposed within the cavity 29 for extracting RF electromagnetic energy from the cavity.

The MSDC 30 is axially disposed beyond the drift tube portions at an end of the tube, and has a plurality of collector electrodes 32, 34, 36 and 38. Each of the collector electrodes are generally annular shaped having a funnel portion tapering in the direction of the IOT 10. A potential is applied to each of the collector electrodes to depress their voltage relative to the IOT 10, as will be fully explained below.

Power to the electron gun 12 and MSDC 30 is provided by a transformer 40 receiving an alternating current (AC) input power source. First rectification diodes 481 and 482 provide potential to the first collector stage 32. Second rectification diodes 461 and 462 provide potential to the second collector stage 34. Third rectification diodes $44_1$ and $44_2$ provide potential to the third collector stage 36. Fourth rectification diodes $42_1$ and $42_2$ provide potential to the fourth collector stage 38. In the embodiment of FIG. 1, the fourth rectification diodes $42_1$ and $42_2$ also provide the same potential level to the cathode .15. Integrating filter capacitors 52, 54, 56 and 58 are respectively included to maintain constant potential on each of the electrodes. The potential applied to each successive collector stage is generally an increasing percentage of the cathode potential, with the final electrode stage being at or near the cathode potential.

An RF input signal is applied between cathode 15 and control grid 14, while a steady DC potential typically between 10 and 30 kilovolts is maintained between the cathode 15 and the anode 16, the anode preferably at ground potential. An electron beam of high DC energy is formed and accelerated toward the anode 16 at high potential, and passes therethrough with minimal interception. A magnetic field outside the vacuum envelope of the IOT 10 is provided to focus the beam and confine it to a constant diameter as it travels from the IOT 10 to the MSDC 30. The RF input signal which is inducted into the grid 14 modulates the electron beam, forming density modulation or "bunching" of electrons in correspondence with the RF signal frequency, as illustrated at 18 in FIG. 1. The density modulated beam passes through the anode 16 and across the gap 27 between the first and second portions of the drift tube. Passage across the gap 27 induces a corresponding electromagnetic wave RF signal in the output cavity 29 which is highly amplified as compared to the input signal. This RF wave energy is then extracted from the tube 10 via the output 25, by use of inductive or capacitive coupling.

After passing through the drift tube portions 22 and 24, the now spent electron beam enters the MSDC 30. Depending on the energy of the electrons within the beam, the electrons are efficiently collected on one of the collector electrodes 32, 34, 36 or 38. Electrons having the highest energy level would travel all the way to the fourth collector stage 38, while the electrons with lesser amounts of energy would be collected on one of the previous stages.

By operating the IOT 10 as a Class B amplifier, no electron beam current from the cathode flows through the grid 14 during the negative half cycle of the RF input signal to the grid. During each positive half cycle, a pulse of RF current flows through the cavity 29 and gives up some of its energy to the electric field formed in the gap 27. Both the height of the current pulse and the average current in the chain of pulses will increase as the RF driving voltage on the control grid is increased, and the RF current in the chain of pulses, $I_{RF}$, will increase in proportion to the DC beam current I. Thus, the output power of the IOT is equal to $I_{RF}^2R$, where R is the shunt resistance presented to the beam at the gap 27.

In the multistage depressed collector, the minimum excess energy of the electrons emerging from the tube will be proportional to the difference between the DC beam voltage and the RF voltage. This excess energy is recovered by collecting the electrons on the collector stages at potentials between the cathode voltage and the beam voltage. As the RF driving voltage is increased, the RF current in the cavity causes a voltage $V_{RF}$ to appear across the shunt resistance. Thus, if there are enough collector stages so the collection potential is near $V_{RF}$, the DC input power to the tube is very nearly proportional to $V_{RF}I$.

By combining the inductive output tube 10 with the multistage depressed collector 30, a surprising result is obtained. Not only will the DC beam current be proportional to $I_{RF}$, but the effective beam collection voltage will be proportional to $V_{RF}$ and the input power to the IOT 10 will be proportional to $I_{RF}V_{RF}$, or its output power. The efficiency for the IOT is very nearly constant and independent of the level at which the amplifier is operating. Not only is the peak efficiency of the IOT increased by collecting the electrons more efficiently at maximum power, but very near peak efficiency is obtained at all levels of operation. By increasing the beam voltage and beam current to levels sufficient to sustain a very high instantaneous power, and avoiding the collection of any of this current on electrodes held at this potential, the IOT can achieve extremely linear amplification. All the beam current would be collected on the depressed stages and there would be no efficiency penalty.

Although FIG. 1 discloses a collector 30 having four depressed stages, it should be apparent that five, six or any number could be advantageously utilized. However, as the number of collector stages increases, the complexity of the device also increases to a point in which the benefit of increased efficiency is overcome by the complexity. In actuality, the end of the IOT 10 structure before the collector 30, illustrated at 31 in FIG. 1, is at the anode potential and may act as a first collector electrode. As will be explained below, when the RF output voltage is limited to improve linearity, maximum efficiency is obtained by precluding collection of the spent electrons on this first electrode at anode potential.

Figure 2:
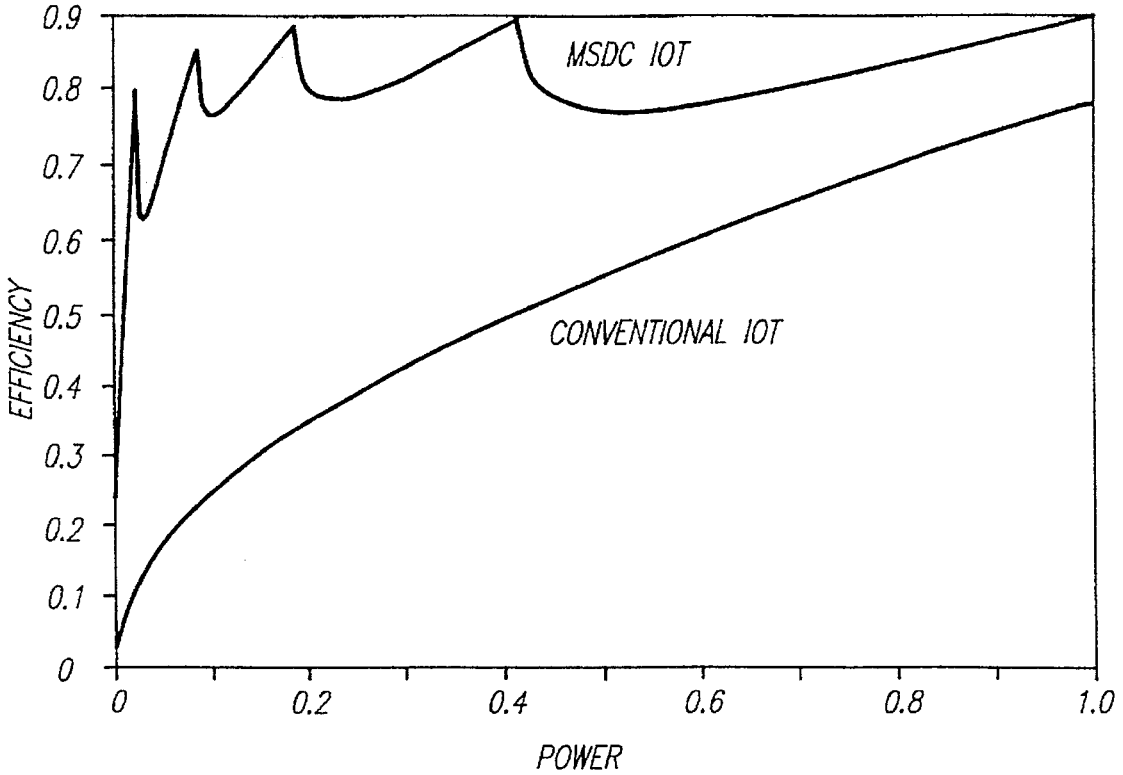
FIG. 2 is a graph depicting expected efficiency for an inductive output tube using five depressed collector stages.

The exact voltages selected for each stage should be adjusted to minimize the power input to the IOT for the particular statistical character of the RF signal being amplified. For example, FIG. 2 shows the theoretical efficiency for an IOT of the present invention across a power range of the device, where POWER represents an associated fraction of the electron beam voltage. The IOT of FIG. 2 is illustrated having five depressed collector stages at 0.7, 0.45, 0.3, 0.2 and 0.1 times the beam voltage and a maximum RF output cavity voltage equal to 0.7 times the beam voltage, compared with the efficiency of a conventional IOT across a full range of power for the IOT. Each of the efficiency peaks for the MSDC IOT in FIG. 2 correspond with the particular collector electrode potentials which were selected. The efficiencies were calculated assuming half sine wave current pulses and sinusoidal output gap voltages. This assumption results in 78.5% maximum efficiency for the conventional IOT and efficiencies between 80% and 90% over most of the power range for the MSDC IOT. Note that the actual value experienced in UHF amplifier practice for either the conventional or MSDC IOT would be somewhat reduced due to space charge effects and transit time spreading of the electrons.

Figure 3:
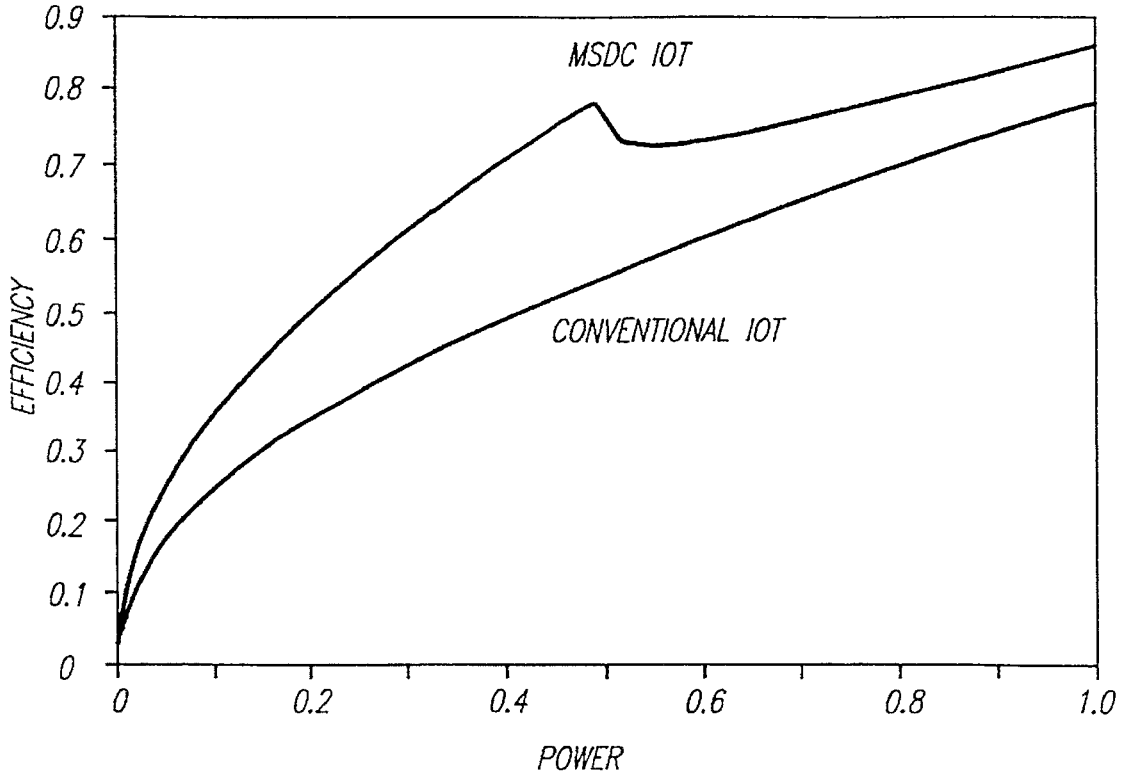
FIG. 3 is a graph depicting expected efficiency for an inductive output tube having a first collector electrode formed by the tube structure at full beam potential and a second collector electrode at a depressed voltage.

Improved efficiency can be realized by the present invention over a narrower range of power output with only a single depressed collector electrode having a potential selected to coincide with the lowest power output required. For example, FIG. 3 shows the efficiency of an IOT with the end of the IOT acting as a first collector electrode at full beam voltage, and with a second electrode within the Collector 30 depressed to 0.7 times the beam voltage, compared with the efficiency of a conventional IOT. Thus, the RF amplifier of the present invention is adjusted to provide near constant high efficiency at any power level between one-half maximum power and maximum, rather than the square root of output power relationship provided by inductive output tubes and multistage depressed collector klystrons.

It will be apparent to those skilled in the art that by varying the number of depressed collector stages and their respective potentials, one can optimize average efficiency for any statistical character of the signal being amplified. Since an HDTV transmitting system would be expected to operate with a mean power 0.1 times the maximum power, several low voltage electrodes will be necessary for maximum energy recovery at this operating level.

Figure 4:
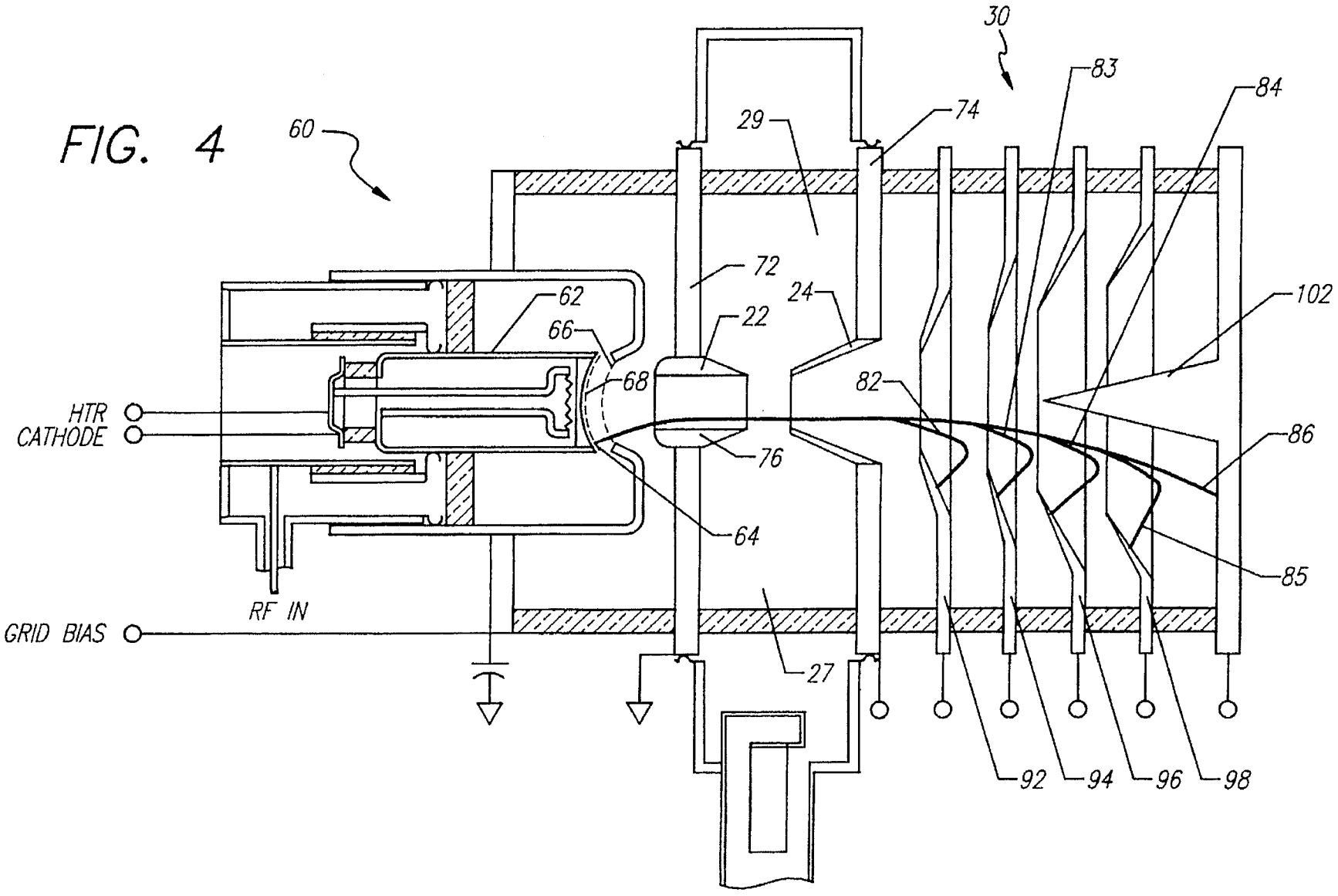
FIG. 4 is a side view of an embodiment of the MSDC inductive output tube of the present invention.

In an embodiment of the present invention, an IOT 60 having a MSDC is illustrated in FIG. 4, in which like elements from the schematic of FIG. 1 share like numerals. The IOT 60 has a modified cathode 62 having a shadow grid 64, a control grid 66, and a convergent cathode surface 68. The cathode 62 is coupled to a thermionic heater voltage source (illustrated as HTR in FIG. 4) and an emitting surface voltage source (illustrated as CATHODE in FIG. 4). The shadow grid 64 and the control grid 66 can be formed of a perforated or wire mesh-like material of a refractory metal, such as molybdenum or tungsten, and may be coated with a primary electron emission suppression material, such as titanium. The shadow grid 64 is operated at a DC potential at or very close to the cathode potential, and the control grid 66 receives the RF input signal (illustrated as RFIN in FIG. 4). The shadow grid 64 shadows the control grid 66 so that no electrons strike the control grid. Since the control grid 66 reaches a fairly high positive potential at the peak of the RF drive voltage, shielding it from electrons by interposing the shadow grid 64 between it and the cathode 62 substantially reduces the grid heating power, the temperature of the grid, and the likelihood of primary electron emission from the grid. A shadow grid arrangement is disclosed in U.S. Pat. No. 4,737,680, for GRIDDED ELECTRON GUN, which is owned by the common assignee.

The convergent cathode surface 68 is generally concave, with the shadow grid 64 and control grid 66 having similar shapes. An anode 76 is formed by the front of the first drift tube portion 22, and is at ground potential. The electric field lines from the control grid 66 and the anode 76 reach through the shadow grid 64 and make the off-cathode potential gradient positive over some area behind the openings in the grids from which the cathode emits electrons. By adjusting the average (bias) voltages of the shadow grid 64 and control grid 66 with respect to the cathode surface 68 (illustrated as GRID BIAS in FIG. 4), improved linearity of the cathode current as a function of the RF control grid voltage can be achieved.

Electrons thermionically emitted from the cathode surface 66 follow a path generally perpendicular to the cathode surface, and become focused into a generally linear beam by the magnetic field directed into the IOT from outside the vacuum envelope. The magnetic field may be provided by a solenoid magnet (not shown), and is directed into the device by iron plates 72 and 74 on either side of the output cavity 29. The size of the hole through the plate 72 contributes to shaping the magnetic field in the region between the cathode 62 and the anode 76 so that the magnetic field lines are fairly similar to the desired electron trajectories. This way, all emitted electrons are guided from the cathode surface 68, through the anode 76, through the output cavity 29 and into the collector region at all current levels. The collector includes five depressed stages illustrated at 92, 94, 96, 98 and 102. As explained above, the end of the IOT structure 74 acts as a first collector stage, and is at the anode potential. The final collector stage 102 is shaped as a spike to form a radial electric field region to force incoming electrons radially outward so that they impinge perpendicularly onto one of the previous collector electrodes.

The pulses of beam current passing through the gap 27 of the output cavity 29 induce magnetic and electric fields in the cavity, and the electric field extracts energy from the electrons. At low currents, the fields in the output cavity 29 will be low and the minimum energy of the electrons leaving the gap 27 will be high. At high currents, the cavity fields will be high and the minimum energy of the electrons leaving the output cavity will be low. Depending upon the current level and the instantaneous fields in the output cavity, an electron might follow a trajectory similar one of to those marked as 82, 83, 84, 85 or 86. Because the collector electrodes are connected to decreasing potentials, the more energy an electron has, the more deeply it will penetrate into the MSDC 30. When it has lost all its energy, it will turn around and be collected by the first collector stage it hits. Fortunately, space-charge forces push the electrons outward radially, and there is a high probability that an electron will be collected on the collector stage of the lowest possible potential.

Amplitude and phase distortion are the result of nearly stopping some electrons in the output gap. To achieve excellent amplitude linearity and low phase distortion, the RF voltage at the output gap 27 should be maintained between approximately 90 and 75% of the cathode to anode potential. At this voltage, the slowest electrons would have between approximately 10 and 25% of the original beam energy or about 32 to 50% of the original beam velocity. This can be achieved by adjusting the impedance of the output gap. If the first collector electrode 92 has a potential equal to the peak amplitude of the RF cavity gap voltage, all of the current can be collected on the collector electrodes, and the efficiency will be higher than that of existing inductive output tubes without depressed collectors while providing much more faithful amplification of the signal.

It should be apparent to those skilled in the art that a functional inductive output tube with a multistage depressed collector will require cooling devices to maintain the temperature of the collector within a reasonable range. Such cooling devices may include a water jacket, or air fins. In addition, bi-metallic structures would typically be incorporated to compensate for differential thermal expansion.

Having thus described a preferred embodiment of an inductive output tube with multistage depressed collector electrodes and methods of adjusting it to achieve optimum performance when amplifying signals with different statistical characteristics, it should now be apparent to those skilled in the art that the aforestated objects and advantages for the within system have been achieved. It should also be appreciated by those skilled in the art that various modifications, adaptations and alternative embodiments thereof may be made within the scope and spirit of the present invention, which is further defined by the following claims.

What is claimed is:

1. A linear amplifier for amplifying a radio frequency signal having a high ratio of peak to average power, comprising:

an electron gun assembly having a cathode and an anode spaced therefrom, said cathode being coupled to a voltage source providing said cathode with a relatively high voltage potential relative to said anode, said cathode providing an electron beam in response to said relatively high voltage potential;

a control grid spaced between said cathode and anode, and being coupled to an input source that applies said radio frequency signal to said grid in order to density modulate said beam, said grid being coupled to a first bias voltage source providing said grid with a first bias voltage relative to said cathode to preclude transmission of said electron beam during the negative half cycle of said radio frequency input signal;

a drift tube spaced from said electron gun and surrounding said beam and including a first portion and a second portion, a gap being defined between said first and second portions;

an inductive output cavity coupled with said drift tube, said density modulated beam passing across said gap and inducing an amplified radio frequency signal into said cavity; and a collector spaced from said drift tube, the electrons of said beam passing into said collector after transit across said gap, said collector having a plurality of electrode stages each having a respective electric potential applied thereto ranging between ground and said cathode potential to efficiently collect said electrons, said respective electrode stage potentials having corresponding voltage values such as to provide near-constant and high efficiency across a power range of said radio frequency signal.

2. The linear amplifier of claim 1, further comprising means disposed within said cavity for extracting said amplified radio frequency signal from said inductive output cavity.

3. The linear amplifier of claim 1, wherein there are at least two of said electrode stages.

4. The linear amplifier of claim 1, wherein said radio frequency input signal is a UHF frequency signal.

5. The linear amplifier of claim 1, further comprising means, coupled to said linear amplifier, for providing a magnetic field within said drift tube to focus and confine said beam at least to said gap.

6. The linear amplifier of claim 1, wherein a first of said electrode stages has an electric potential equal to said cathode potential, and a second of said electrode stages has a depressed potential equal to a fraction of said cathode potential.

7. The linear amplifier of claim 1, wherein each said electric potential applied to said respective collector electrodes is adjusted to preclude collection of said electrons at said anode potential.

8. The linear amplifier of claim 1, further comprising a shadow grid disposed between said control grid and said cathode.

9. The linear amplifier of claim 8, further comprising a second bias voltage source coupled to said shadow grid providing said shadow grid with a second bias voltage relative to said cathode.

10. The linear amplifier of claim 1, wherein said electrode stage potentials have a substantially non-uniform voltage difference between each one of said electrode stages such as to provide said near-constant efficiency.

11. A method for amplifying a UHF frequency signal having a high ratio of peak to average power comprising the steps of:

accelerating an electron beam from an electron gun assembly having a cathode and an anode spaced therefrom by application of a relatively high voltage potential between said cathode and said anode;

density modulating said electron beam by application of said UHF frequency signal to a control grid disposed between said cathode and said anode;

electrically biasing said control grid relative to said cathode to preclude transmission of said electron beam during the negative half cycle of said UHF frequency signal;

passing said density modulated beam across a gap to induce an amplified UHF signal into a cavity coupled to said gap;

extracting said amplified UHF signal from said cavity; and collecting the electrons of said beam remaining after transit across said gap on a plurality of electrode stages, each stage respectively having electric potential applied thereto ranging between ground and said cathode potential, said respective electrode stage potentials being selected to have corresponding voltage values such as to provide near-constant high efficiency across a power range of said UHF signal.

12. The method of claim 11, wherein said collecting step further comprises the step of providing at least two of said electrode stages.

13. The method of claim 11, further comprising the step of focusing said electron beam by providing a magnetic field at least to said gap.

14. The method of claim 11, further comprising the step of selecting said electric potential of each stage to preclude collection of said electrons at the potential of said anode.

15. The method of claim 11, wherein said collecting step further comprises the steps of applying an electric potential equal to a potential of said electron beam to a first of said electrode stages, and applying a depressed potential equal to a fraction of said beam potential to a second of said electrode stages.

16. A linear amplifier for amplifying a UHF frequency signal having a high ratio of peak to average power, comprising:

an electron gun assembly having a cathode and an anode spaced therefrom, said cathode being coupled to a voltage source providing said cathode with a high voltage potential relative to said anode, said cathode providing an electron beam in response to said high voltage potential;

a control grid spaced between said cathode and anode, and means for density modulating said electron beam by application of said UHF frequency signal to said control grid, said control grid being coupled to a bias voltage source providing said grid with a bias voltage relative to said cathode to preclude transmission of said electron beam during the negative half cycle of said UHF frequency signal;

a drift tube spaced from said electron gun and surrounding said beam and including a first portion and a second portion, a gap being defined between said first and second portions;

an inductive output cavity coupled with said drift tube, said density modulated beam passing across said gap and inducing an amplified UHF frequency signal into said cavity;

means, disposed within said cavity, for extracting said amplified UHF frequency signal from said inductive output cavity; and a multistage depressed collector spaced from said drift tube, the electrons of said beam passing into said collector after transit across said gap and being collected on a plurality of electrode stages therein, each stage respectively having electric potential applied thereto ranging between ground and said cathode potential, wherein said respective electric potential applied to each one of said electrode stages precludes collection of said electrons having a potential equal to that of said anode, said respective electrode stage potentials having corresponding voltage values such as to provide a near-constant level of efficiency across a power range of said UHF frequency signal.

17. The linear amplifier of claim 16, further comprising means, coupled to said linear amplifier, for providing a magnetic field within said drift tube to focus and confine said beam at least to said gap.

18. The linear amplifier of claim 16, wherein said respective electric potentials have corresponding voltage values which substantially provide a non-uniform voltage difference between each of said electrode stages to provide said near-constant level of efficiency for said UHF frequency signal.

19. The linear amplifier of claim 16, wherein said grid is biased for Class B operation.

20. The linear amplifier of claim 16, further comprising a shadow grid disposed between said control grid and said cathode.

21. The linear amplifier of claim 20, further comprising another bias voltage source coupled to said shadow grid providing said shadow grid with another bias voltage relative to said cathode.

22. The linear amplifier of claim 16, wherein there are at least two of said electrode stages.

* * * * *